United States Patent [19]

Nadolski

[11] 4,307,394

[45] Dec. 22, 1981

[54] SYSTEM FOR DRIVING A GAS DISCHARGE DISPLAY

[75] Inventor: James J. Nadolski, Bayonne, N.J.

[73] Assignee: Sangamo Weston, Inc., Norcross, Ga.

[21] Appl. No.: 148,620

[22] Filed: May 12, 1980

[51] Int. Cl.[3] ..... G09F 9/32

[52] U.S. Cl. ..... 340/789; 315/169.1; 340/758; 340/802

[58] Field of Search ..... 340/700, 713, 752, 758, 340/761, 766, 767, 768, 771, 776, 789, 802, 804, 811; 315/169 R

[56] References Cited

U.S. PATENT DOCUMENTS 3,679,933 7/1972 Nakada et al. ..... 340/758
3,815,120 6/1974 Kanda ..... 340/758

OTHER PUBLICATIONS

Beckman; "Multiplexed Operation of Displays;" Feb. 1977; 7 pp.

*Primary Examiner*—Alvin H. Waring
*Attorney, Agent, or Firm*—Joseph J. Kaliko; Mikio Ishimaru; Dale Gaudier

[57] ABSTRACT

An improved system for driving a gas discharge display which prevents streamers of ionized gas from forming between adjacent character positions. Each of a plurality of character positions has an anode driver to which anode drive signals are sequentially applied. All odd character positions share a first cathode decoder/driver and all even character positions share a second cathode decoder/driver. Cathode drive signals are simultaneously applied to the first and second decoder/driver circuits. A first logic device, responsive to all odd position anode drive signals, outputs a blanking signal which is applied to the blanking input of the even character cathode decoder/driver to bias all even character cathodes into a non-conducting state whenever an anode drive signal is applied to an odd character anode. A second logic device, responsive to all even position anode drive signals, outputs a blanking signal which is applied to the blanking input of the odd character cathode decoder/driver to bias all odd character cathodes into a non-conducting state whenever an anode drive signal is applied to an even character anode. Thus, when a particular character position is scanned by the anode drive signals and selected cathode segments thereof are energized the cathodes of adjacent character positions are biased into a non-conducting state making it impossible for streamers of ionized gas to form between the energized character and its neighbors.

18 Claims, 2 Drawing Figures

SYSTEM FOR DRIVING A GAS DISCHARGE DISPLAY

BACKGROUND OF THE INVENTION

1. Field of the Invention

The invention relates to the field of gas discharge displays and more particularly to an improved method and apparatus for multiplex driving of such displays.

2. Description of the Prior Art

Gas discharge displays generally include one or more character positions defined within a gas filled envelope. Each character position includes at least one anode and one or more segmented character forming cathodes. When a potential difference of sufficient magnitude is established between the anode and one or more of the character segment cathodes the gas therebetween (usually neon or a neon mixture) ionizes to produce a visual display of the energized character segments. A familar type of such display includes a plurality of character positions each having a seven-segment character cathode formed on a common substrate. A seven-segment decoder/driver is used to convert an input signal to be displayed into drive signals for energizing appropriate ones of the character cathode segments. Such displays find wide application due to their inherent advantages of high brightness and good visibility, reliability, and a pleasing orange-red display color.

Several techniques for driving gas displays are known. The simplest technique is termed DC drive in which all character positions are on (lighted) at one time. As a consequence, each character requires its own decoder/driver. Although such an arrangement has the virtue of simplicity, as the number of character positions is increased above about four or five, the costs of additional decoder/drivers and associated circuitry makes DC drive less cost effective than the other major type of drive, multiplex drive.

In multiplexed operation, characters in the display are not on at one time (as in DC drive) but rather are individually switched on in some sequence at a high repetition rate. Two or more character positions thus "time-share" a single cathode driving device.

The most common method of multiplexing is to connect all like cathode segments in parallel to one cathode driver and scan the display anodes in one of two ways: sequential scan, where each anode is successively switched on for a brief period, or interlaced scan in which anodes are scanned in any sequence so long as no two adjacent digits are successively energized.

Advantages of multiplexed operation include reduced circuitry requirements and thus reduced costs for the display. One major disadvantage of multiplexed operation of gas discharge displays is that when sufficient potential difference exists between the anodes of adjacent characters, the anode with the lower potential will acts as a cathode for the pair and spurious ionization may cause a cosmetic defect called a streamer to appear between two character positions. Such a condition can also exist between two cathodes. Streamers can also occur when the anode of one character position acts as the anode for an adjacent character position. This condition occurs when insufficient blanking time (time for de-ionization) is allowed between adjacent character anode scans.

Several techniques are known for preventing streamers. To prevent the formation of streamers during sequential scanning, the removal of turn on voltage from, and the application of turn on voltage to, adjacent character positions is separated in time by electrode (anode or cathode) blanking. Blanking creates a "dead time" between the on times of adjacent character positions so that ionization from a deenergized digit can sufficiently decay before the next character position is energized. However, inter-character blanking has the disadvantage of requiring special circuitry for controlling character "on" and character blanking time. Further, the upper frequency of operation is somewhat limited since the scan rate is a function of both character "on" and blanking times.

An alternative technique is interlaced scanning in which character positions are scanned such that no two adjacent character positions are successively scanned. For example, in a five character display, the anodes associated with character positions 1, 3, 5 would be scanned followed by a scan of positions 2 and 4. Interlaced scanning thus increases the distance between successively energized character positions and eliminates the need for blanking, but at the expense of requiring more complex scanning circuitry than is needed for sequential scanning.

A third technique for preventing streamers is known as split-cathode multiplexing. In split-cathode multiplexing character positions are paired and physically isolated (e.g. in separate display packages) from adjacent character pairs. Each pair of character positions shares an anode driver and all anode drivers are addressed simultaneously. The odd and even character positions of each pair are alternately driven by first and second cathode drivers. Since successively energized character pairs are separated by the display envelopes, the need for blanking is eliminated as streamers are a physical impossibility. However, split-cathode multiplexing requires somewhat complex addressing circuitry to simultaneously generate the anode drive signals and alternately actuate the odd and even cathode drive signals. Further, such a scheme is useful only in displays where character pairs can be physically isolated from their neighbors.

SUMMARY OF THE INVENTION

It is therefore a primary object of the invention to provide a system for driving a gas discharge display which prevents the formation of streamers between adjacent character positions.

It is a more specific object to provide such a system for driving a gas discharge display having a plurality of character positions defined within a common envelope.

It is a further object to provide a system for driving a gas discharge display which is simple and reliable in operation and which requires no complex drive circuitry.

These and other objects are achieved by the present invention wherein there is provided an improved method and apparatus for driving a gas discharge display. Broadly, the method comprises sequentially applying anode drive signals to the character anodes, simultaneously applying cathode drive signals to selected cathodes of each of the characters, the cathode drive signals being indicative of one or more character cathode segments to be energized, and biasing all even character cathodes into a non-conducting state whenever an anode drive signal is applied to an odd character anode and biasing all odd character cathodes into a non-conducting state whenever an anode drive signal is applied to an even character anode. Such an arrangement prevents streamers from forming between adjacent character positions because all cathodes of characters adjacent an energized character (e.g. one to which both cathode and anode drive signals have been applied) will be effectively blanked and incapable of conducting.

In one embodiment, the invention is directed toward a method of driving a digital display according to the above-described broad aspect of the invention, wherein an analog or digital input signal is converted into a digital signal and the digital signal is multiplexed to generate scanning signals for sequentially driving the character anodes and to simultaneously generate character segment selection signals for energizing selected ones of the character cathodes, so as to produce a visual display of a parameter of the input signal.

Apparatus for performing the inventive method broadly comprises means for sequentially generating and applying anode drive signals to the character anodes, means for generating and applying cathode drive signals simultaneously to selected cathodes of each of the characters, the cathode drive signals being indicative of one or more character cathode segments to be energized, and means responsive to the anode drive signals for biasing all even character cathodes into a non-conducting state whenever an anode drive signal is applied to an odd character anode and for biasing all odd character cathodes into a non-conducting state whenever an anode drive signal is applied to an even character anode.

More specifically, the invention contemplates apparatus for displaying a digital representation of a parameter of an analog or digital input signal. The apparatus includes means for converting the input signal to a digital signal, means for multiplexing the digital signal and for generating therefrom the sequential anode drive signals and the cathode drive signals. Preferably, the digital signal takes the form of a binary coded signal which is applied to first and second decoder/drivers connected respectively to all the even character cathodes and to all the odd character cathodes, the decoder/drivers generating the cathode drive signals which energize selected segments of the display. Each decoder/driver has a blanking input which, when activated, causes all cathode segments associated with the decoder/driver to be electrically isolated and hence non-conductive with respect to their associated anode. The blanking input of the odd character decoder/driver is responsive to anode drive signals applied to even character anodes and the blanking input of the even character decoder/driver is responsive to anode drive signals applied to odd character anodes. In operation, as successive character anodes are sequentially energized, the cathodes of characters adjacent to the energized character will be electrically isolated due to the application of a blanking input signal to their associated (odd or even) decoder/driver. Since the cathodes of characters adjacent the energized character are electrically isolated, streamers cannot occur between these isolated cathodes and the energized character anode.

The invention thus possesses the simplicity of sequential anode scanning, while preventing streamer formation, without resort to costly and complex inter-character blanking or interlace scanning schemes, or the packaging limitations inherent in split-cathode multiplexing.

BRIEF DESCRIPTION OF THE DRAWING FIGURES

These and other features and advantages of the present invention will be apparent from the following detailed description of the invention when taken in conjunction with the accompanying drawing figures wherein:

FIG. 1 is a schematic diagram illustrating a preferred embodiment of the present invention; and FIG. 2 is a diagram illustrating the relationship of various waveforms as measured during a TEST mode at selected points in the circuit of FIG. 1.

DETAILED DESCRIPTION OF THE PREFERRED EMBODIMENT

Figure 1:
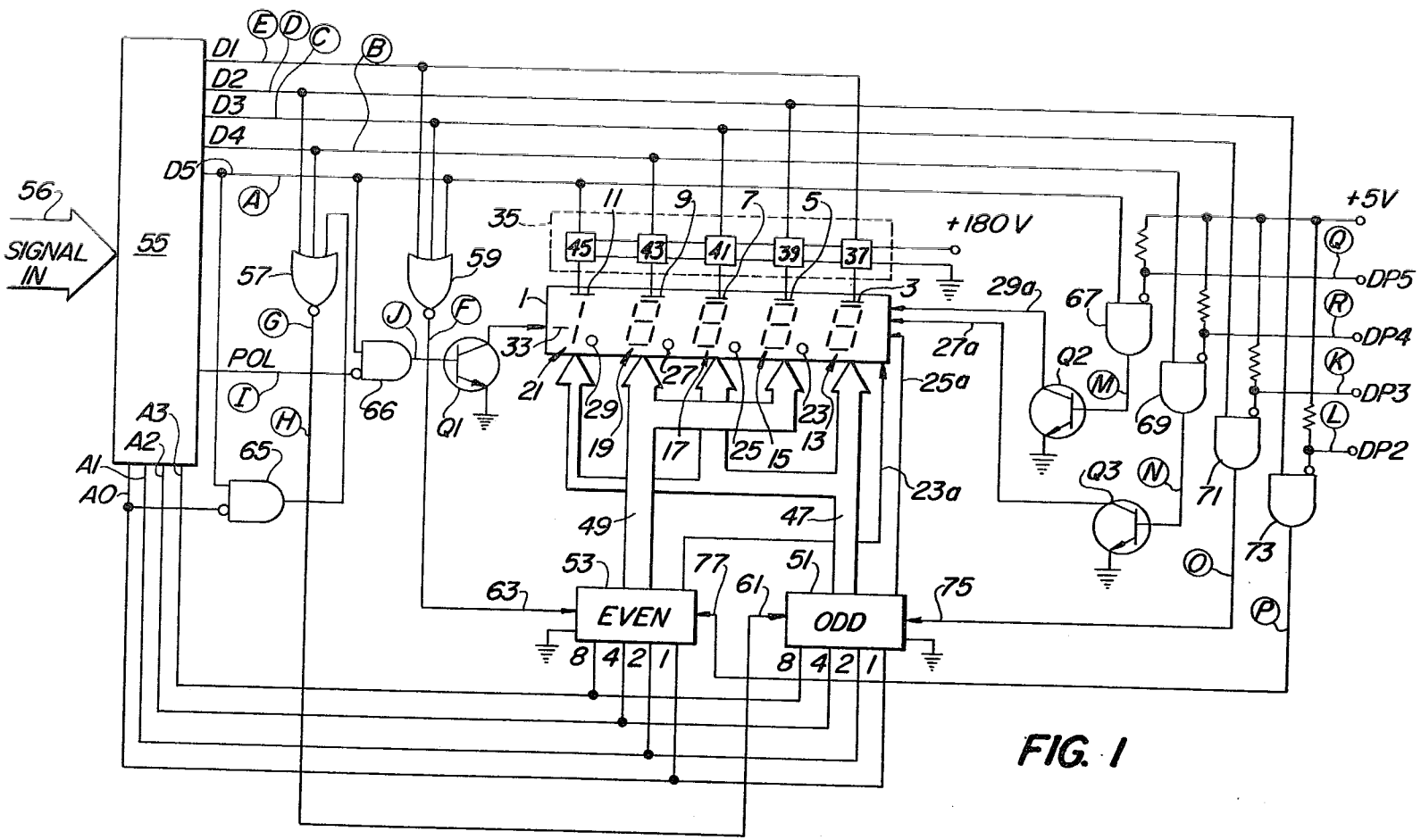

Referring to FIG. 1, there is shown a preferred arrangement for driving a gas discharge display device 1. As illustrated in FIG. 1, device 1 is a $4\frac{1}{2}$ digit display of the seven-segment type. Such displays are sold by Beckman Instruments, Inc. of Scottsdale Arizona. These displays include at least one anode 3, 5, 7, 9 and 11 and one or more character cathode segments associated with each respective character position 13, 15, 17, 19 and 21. Display 1 also includes decimal point cathodes 23, 25, 27 and 29 respectively associated with character positions 15, 17, 19 and 21, and a negative polarity indicating cathode 33 formed adjacent the over-range character position, 21.

Display 1 is driven by means of sequential anode drive signals applied along lines $D_1$–$D_5$ to anode driver package 35. Anode driver 35 illustratively includes five drive switches 37, 39, 41, 43 and 45 respectively associated with character anodes 3, 5, 7, 9 and 11 and anode drive lines $D_1$–$D_5$. One side of each anode drive switch is connected to a source of high voltage, for example +180 volts DC. A digital pulse (for example in positive logic: +5 volts=logic 1, and 0 volts=logic 0) applied to an anode drive line will cause its associated switch to conduct and apply the +180 volt supply voltage to its associated display anode.

Each character position has associated with it a plurality of cathode drive lines, shown as data bus lines 47 and 49. For a display utilizing seven-segment cathodes, as shown in FIG. 1, each bus line comprises a minimum of seven lines for driving the character cathodes, except for over-range character 21 which requires a minimum of two lines. Bus 47 is connected in parallel to all odd character positions 13, 17 and 21, while bus 49 is connected in parallel to all even character positions 15 and 19.

Busses 47 and 49 are respectively connected to odd character decoder/driver 51 and even character decoder/driver 53. Each decoder/driver acts to take a signal which is applied to its input in binary coded form, for example binary coded decimal (BCD), and decode and convert the input signal into signals which establish a potential difference between selected cathode segments (corresponding to a desired character or numeral to be displayed) and an energized anode. Decoder/drivers 51 and 53 are, for example, type DS 8980 BCD-to-7-segment decoder/drivers manufactured by National Semiconductor.

The inputs to decoder/drivers 51 and 53 are connected in parallel and thus each decoder/driver simultaneously receives BCD cathode drive signals along lines $A_o$–$A_3$. The BCD signals applied along lines $A_o$–$A_3$ are representative of a character which is to be displayed, such as a digit from 0–9. The BCD signals can be generated by a variety of means well known in the art. Such means, as shown in FIG. 1, comprises an input signal converting device 55, for example a monolithic analog-to-digital converter (for use with analog input signals) or signal conditioning circuitry (for use with digital input signals), including multiplexed outputs connected to anode drive lines $D_1$–$D_5$ and BCD signal outputs connected to lines $A_0$–$A_3$. Device 55 receives an analog or digital input signal having a parameter to be displayed at one or more inputs, denoted generally at 56 in FIG. 1. The input signal is then converted into a digital signal, and the digital signal is converted into BCD format with signals indicative of a character to be displayed at a particular position being sequentially outputted along lines $A_0$–$A_3$.

Device 55 also derives timing signals and multiplexes the digital signals to sequentially output anode drive pulses along lines $D_1$–$D_5$. In the embodiment shown in FIG. 1, the anodes of the display are scanned from the most significant digit (MSD) to the least significant digit (LSD), i.e. from left to right. This is accomplished by strobing anode drive lines $D_1$–$D_5$ in the following order: $D_5$, $D_4$, $D_3$, $D_2$, $D_1$, $D_5$, $D_4$. . . , etc. Thus, common cathode segments of the various character positions are driven simultaneously in parallel, while the character anodes are sequentially scanned. Only one character position at a time is illuminated since gas discharge only occurs when an anode of a particular character position has the supply voltage connected thereto and one or more cathode segments of the selected character are energized.

An important feature of the present invention is that while sequential anode scanning is used, with its advantage of simple drive circuitry, streamers are prevented without resort to costly and complex inter-character blanking circuitry. This is accomplished by the provision of two logic gates 57 and 59 respectively connected to even character anode drive lines $D_2$ and $D_4$ and odd character anode drive lines $D_1$, $D_3$ and $D_5$. Each gate functions to output a LOW (logic 0) signal whenever any one of its three inputs has a HIGH (logic 1) signal applied thereto. In the absence of any input signals (all inputs LOW) the output of either of gates 57 and 59 is a HIGH signal. Gates 57 and 59, for example, are three input NOR gates. The outputs of gates 57 and 59 are applied respectively to blanking inputs 61 and 63 of odd and even character decoder/drivers 51 and 53.

The blanking inputs of decoder/drivers 51 and 53 control internal circuitry of each decoder for switching all cathode drive lines (busses 47 and 49) to and from a current source (for example, ground). A HIGH signal at the blanking input causes the cathode drive lines to be connected to their current source and thus establish a net negative potential with respect to an energized anode. If a sufficient potential exists between an energized cathode segment and an energized anode, a gas discharge occurs and ionization results. When a LOW signal from one of the logic gates is applied to the blanking input of its associated decoder/driver it causes all cathode drive lines of that decoder/driver to be disconnected from their current source and thus effectively biases the cathodes into a non-conducting state.

Figure 2:
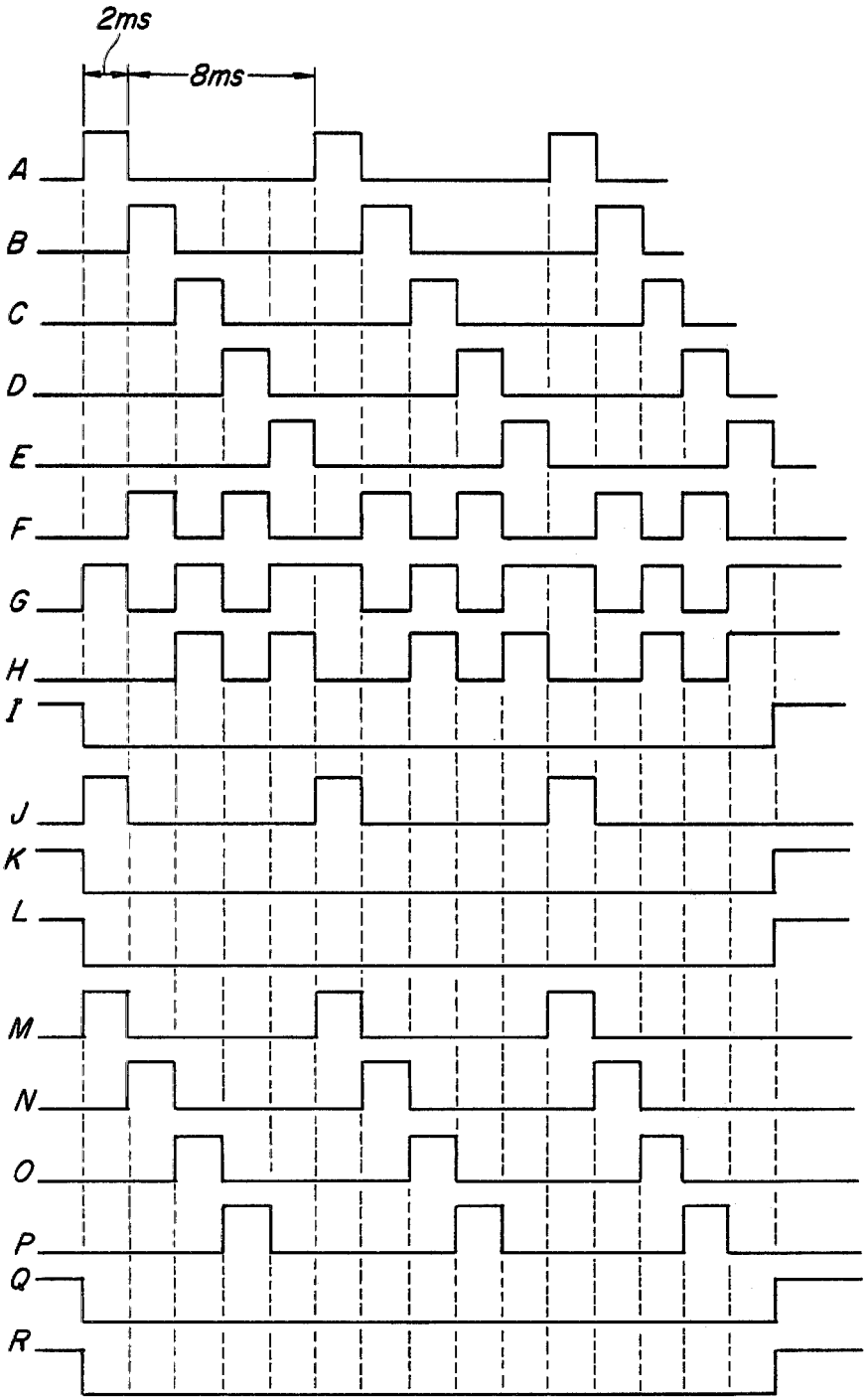

In operation, BCD cathode drive signals are applied simultaneously to the inputs of decoder/drivers 51 and 53 along lines $A_0$–$A_3$. Concurrently, anode drive lines $D_1$–$D_5$ are strobed, as described previously, to sequentially scan and energize the character anodes from left to right. As shown in FIG. 2, each pulse is approximately 2 msec long, with the leading edge of the next pulse substantially concident with the trailing edge of the previous pulse. Each complete scan of the five anodes thus takes approximately 10 msec, implying a scanning frequency of 100 Hz, which is about optimal for minimizing display flicker.

A typical scanning sequence is as follows:

An anode drive signal is applied to line $D_5$ from device 55 causing anode driver 45 to connect anode 11 of character 21 to the source of +180 VDC. Concurrently, a BCD signal indicative of a character to be displayed at character position 21 is output from device 55 along lines $A_0$–$A_3$ and applied simultaneously to both odd and even decoder/drivers 51 and 53. Drive line $D_5$ also provides a HIGH input to gate 59 causing its output to go LOW. The LOW output of gate 59 is applied to blanking input 63 of even decoder/driver 53. This causes all cathodes of even position characters 15 and 19 to be biased into a non-conducting state, while the output of the odd decoder/driver is unaffected. Although the decoder drive signals are applied to all the common cathodes at each of the odd character positions, only the selected cathodes at character position 21 cause a gas discharge because only anode 11 is energized.

Signals from cathode drive line $A_0$ and anode drive line $D_5$ are also coupled to the inputs of gate 65. Gate 65 functions to output a HIGH signal to gate 57 and thus cause the output of odd decoder/driver 51 to be suppressed if and only if line $D_5$ is HIGH and line $A_0$ is LOW. This arrangement is useful when it is desired to suppress a leading zero from being displayed at character position 21.

Upon completion of the display (or leading zero suppression) of a character at position 21, the multiplexer of device 55 causes the next anode drive pulse to appear along line $D_4$ causing anode driver 43 to connect anode 9 of character position 19 to the source of +180 VDC. Concurrently, a BCD signal indicative of a character to be displayed at character position 19 is output by device 55 along lines $A_0$–$A_3$ and applied simultaneously to both odd and even decoder/drivers 51 and 53. Drive line $D_4$ provides a HIGH input to gate 57 causing its output to go LOW. The LOW output of gate 57 is applied to blanking input 61 of odd decoder/driver 51. This causes all cathodes of odd position characters 13, 17 and 21 to be biased into a non-conducting state, while the output of the even decoder/driver is unaffected. Although the decoded drive signals are applied to all the common cathodes at each of the even character positions, only the selected cathodes at character position 19 cause a gas discharge since only anode 9 is energized.

The energization of character positions 17, 15 and 13 continues as above, with all even character position cathodes being biased into a non-conducting state whenever an odd character position anode is scanned, and all odd character position cathodes being biased into a non-conducting state whenever an even character position anode is scanned. This arrangement prevents streamers from occurring because no low impedance path to ground exists through cathodes adjacent to an energized (anode "ON") character position to support spurious ionization. Unlike complex inter-character blanking schemes previously used to prevent streamers when sequential scanning was employed, the present invention merely requires a pair of logic gates to separate the odd and even drive pulses, and a pair of cathode decoder/drivers responsive thereto to drive any number of character positions in a gas discharge display.

Several other features shown in FIG. 1 make the invention useful as a digital (numerical) display. As mentioned earlier, display 1 includes a negative polarity indicator 33. Normally the "minus" indicator is not energized. However, the application of a polarity reversal signal "POL" generated by device 55 (which includes internal circuitry for automatic detection of the polarity of an input signal) causes gate 66 and NPN transistor $Q_1$ to switch the "minus" cathode 33 of display 1 ON. When the polarity reversal signal is removed from display 1 the "minus" cathode is automatically extinguished.

Display 1 also includes inputs 23*a*, 25*a*, 27*a* and 29*a* for controlling decimal point cathodes 23, 25, 27 and 29, respectively. The energization of decimal point cathode 29 is controlled by means of the combination of NPN transistor $Q_2$ and gate 67 which is responsive to a HIGH ("1") anode drive signal applied along line $D_5$ and to a LOW ("0") control signal applied at input DP5. These signals simultaneously applied along $D_5$ and at DP5 cause input 29*a* to be placed at ground potential, thus illuminating decimal point cathode 29. Decimal point 27 is illuminated in a similar fashion when control signals are coincidently applied to input DP4 and along anode drive line $D_4$ to gate 69 and thence to $Q_3$. Operation of decimal point cathodes 25 and 23 is similar to that described above with inputs from DP3 and D3 being applied to gate 71, and inputs from DP2 and $D_2$ being applied to gate 73. The outputs of gates 71 and 73 are respectively applied to decimal point drive inputs 75 and 77 of decoder/drivers 51 and 53. Decoder/drivers 51 and 53 each contain internal circuitry for driving cathodes 25 and 23 along lines 25*a* and 23*a*, respectively, thus eliminating the need for additional switching transistors such as $Q_2$ and $Q_3$. Decimal point control signals for application to inputs DP2–DP5 can be derived from a variety of sources, such as manual switches or automatic signal ranging circuitry (not shown).

While the invention has been described with respect to an exemplary embodiment, it is understood that various modifications of the invention will be apparent to those skilled in the art. For example, display 1 can be an alphanumeric display with appropriate modification to the cathode drive circuitry. Cathode drive signals need not be limited to BCD type signals if appropriate decoder/driver means are provided. Indeed, there is no requirement that there be two separate decoder/drivers; one decoder could be used with separate outputs in parallel to the odd and even character positions. Adjacent character blanking could be controlled by switches in each of the two (odd and even) output busses. Various other techniques for deriving the blanking signals, the polarity signal, and the decimal point signals are also possible. It is thus understood that these and other various changes and modifications are within the spirit and scope of the present invention as defined by the appended claims.

What is claimed is:

1. In a gas discharge display including a plurality of characters, each said character having at least an anode and one or more character segment cathodes, a method of driving said display comprising the steps of:

sequentially applying anode drive signals to said character anodes;

applying cathode drive signals to selected cathodes of each of said characters indicative of one or more character segments to be energized; and biasing all even character cathodes into a non-conducting state whenever an anode drive signal is applied to an odd character anode and biasing all odd character cathodes into a non-conducting state whenever an anode drive signal is applied to an even character anode, whereby streamers between adjacent character positions are prevented.

2. The method of claim 1 wherein said steps of applying drive signals to said character anodes and cathodes comprises the steps of:

scanning said character anodes to cause said anodes to be sequentially connected to a source of voltage; and simultaneously establishing a potential different between a scanned anode and selected cathodes of each of said characters, said potential difference being sufficient to cause ionization of the gas between said selected cathodes and a scanned anode.

3. A method of driving a digital display according to claim 1 further including the steps of:

inputting a signal;

converting said input signal to a digital signal; and multiplexing said digital signal to generate said sequential anode drive signals and said cathode drive signals, whereby a digital representation of a parameter of said input signal is displayed.

4. The method of claim 3 wherein said multiplexing step further includes converting said digital signal to a binary coded signal and decoding said binary coded signal to generate said cathode drive signals.

5. The method of claim 3, wherein said display further includes decimal point cathodes associated with one or more of said character positions, and including the step of generating a decimal point drive signal to energize a selected one of said decimal point cathodes.

6. In a gas discharge display including a plurality of characters, each said character having at least an anode and one or more character segment cathodes, a method of driving said display comprising the steps of:

sequentially scanning said character anodes to cause said anodes to be sequentially connected to a source of voltage;

simultaneously establishing a potential difference between a scanned anode and selected cathodes of each of said characters, said potential difference being sufficient to cause ionization of the gas between said selected cathodes and a scanned anode; and biasing all even character cathodes into a non-conducting state whenever an odd character anode is selected during said scanning step and biasing all odd character cathodes into a non-conducting state whenever an even character anode is selected during said scanning step, whereby streamers between adjacent character positions are prevented.

7. A method of driving a digital display according to claim 6 further including the steps of:

inputting a signal;

converting said input signal to a digital signal; and multiplexing said digital signal to generate sequential scanning signals for said anodes and character segment selection signals for said cathodes, whereby a digital representation of a parameter of said input signal is displayed.

8. The method of claim 7 wherein said multiplexing step further includes converting said digital signal to a binary coded signal and decoding said binary coded signal to generate said character segment selection signals.

9. In a gas discharge display including a plurality of characters, each said character having at least one anode and one or more character segment cathodes, the improvement comprising:

means for sequentially generating and applying anode drive signals to said character anodes;

means for generating and applying cathode drive signals to selected cathodes of each of said characters, said cathode drive signals being indicative of one or more character segments to be energized; and means responsive to said anode drive signals for biasing all even character cathodes into a non-conducting state whenever an anode drive signal is applied to an odd character anode and for biasing all odd character cathodes into a non-conducting state whenever an anode drive signal is applied to an even character anode, whereby streamers between adjacent character positions are prevented.

10. The display of claim 9 wherein said means for applying drive signals to said character anodes and cathodes comprises:

a source of voltage;

means for sequentially scanning said character anodes to cause said anodes to be sequentially connected to said voltage source; and means for simultaneously establishing a potential difference between a scanned anode and selected cathodes of each of said characters, said potential difference being sufficient to cause ionization of the gas between said selected cathodes and a scanned anode.

11. A digital display according to claim 9 further including:

means for inputting a signal;

means for converting said input signal to a digital signal; and means for multiplexing said digital signal and for generating said sequential anode drive signals and said cathode drive signals, whereby a digital representation of a parameter of said input signal is displayed.

12. The digital display of claim 11 wherein said means for inputting, converting, and multiplexing a signal comprises:

an input signal converter connected to a source of input signals, said converter including a multiplexer circuit for generating said sequential anode drive signals and a circuit for generating a binary coded signal representative of the measured parameter of said input signal; and means for decoding said binary coded signals and for generating cathode drive signals to energize selected segments of said display.

13. The digital display of claim 12 wherein there are two such means for decoding said binary coded signals, one such decoder/cathode driver being connected to all even character positions of said display and another such decoder/cathode driver being connected to all odd character positions of said display, each said decoder/cathode driver having a blanking input, said odd character decoder/cathode driver having its respective blanking input responsive to anode drive signals applied to even character anodes and said even character decoder/cathode driver having its respective blanking input responsive to anode drive signals applied to odd character anodes, whereby all even character cathodes are electrically isolated and rendered non-conducting whenever an anode drive signal is applied to an odd character anode and all odd character cathodes are electrically isolated and rendered non-conducting whenever an anode drive signal is applied to an even character anode so as to prevent streamers of ionized gas from forming between adjacent cathodes and/or anodes.

14. The display of claim 9 further including decimal point cathodes associated with one or more of said character positions, and including means for generating a decimal point drive signal to energize a selected one of said decimal point cathodes.

15. The display of claim 12 wherein said input signal converter further includes signal polarity detection means and means for outputting a polarity signal to selectively energize polarity indicating cathode segments formed as part of said gas discharge display.

16. In a gas discharge display including a plurality of characters, each said character having at least one anode and one or more character segment cathodes, the improvement comprising:

means for sequentially applying anode drive signals to said character anodes comprising a source of voltage and means for sequentially scanning said character anodes to cause said anodes to be sequentially connected to said voltage source;

means for simultaneously applying cathode drive signals to said cathodes comprising first and second cathode driver means respectively connected to all odd character position cathodes and all even character position cathodes, each said cathode driver including a blanking input, said cathode driver means responsive to said cathode drive signals for establishing a potential difference between a scanned anode and selected cathodes of each of said characters, said potential difference being sufficient to cause ionization of the gas between said selected cathodes and a scanned anode;

means responsive to odd character position anode drive signals for generating and applying a blanking signal to the blanking input of said even character position cathode driver to cause all said even character cathodes to be biased into a non-conducting state; and means responsive to even character position anode drive signals for generating and applying a blanking signal to the blanking input of said odd character position cathode driver to cause all said odd character cathodes to be biased into a non-conducting state, whereby streamers of ionized gas between adjacent character positions are prevented.

17. A digital display according to claim 16 further including:

means for inputting a signal;

means for converting said input signal to a digital signal; and means for multiplexing said digital signal and for generating said sequential anode drive signals and said cathode drive signals, whereby a digital representation of a parameter of said input signal is displayed.

18. The digital display of claim 17 wherein said means for inputting, converting, and multiplexing a signal comprises:

an input signal converter connected to a source of input signals, said converter including a multiplexer circuit for generating said sequential anode drive signals and a circuit for generating a binary coded signal representative of the measured parmaeter of said input signal; and said first and second cathode driver means further including means for decoding said binary coded signals and for generating cathode drive signals to energize selected segments of said display.

* * * * *